US011105510B2

(12) United States Patent
Means et al.

(10) Patent No.: US 11,105,510 B2
(45) Date of Patent: Aug. 31, 2021

(54) ALIGNMENT TOOLS AND METHODS FOR ASSEMBLING COMBUSTORS

(71) Applicant: General Electric Company, Schenectady, NY (US)

(72) Inventors: Gregory Scott Means, Greenville, SC (US); Aaron Tellier, Greenville, SC (US)

(73) Assignee: General Electric Company, Schenectady, NY (US)

( * ) Notice: Subject to any disclaimer, the term of this patent is extended or adjusted under 35 U.S.C. 154(b) by 115 days.

(21) Appl. No.: 16/253,591

(22) Filed: Jan. 22, 2019

(65) Prior Publication Data

US 2020/0232644 A1 Jul. 23, 2020

(51) Int. Cl.
*F23R 3/06* (2006.01)

(52) U.S. Cl.
CPC ..... *F23R 3/06* (2013.01); *F23R 2900/00017* (2013.01); *F23R 2900/03044* (2013.01)

(58) Field of Classification Search
CPC ..... F23R 3/06; F23R 2900/03044; F23R 2900/00017; F23R 3/002; F23R 2900/00012
See application file for complete search history.

(56) References Cited

U.S. PATENT DOCUMENTS 7,010,921 B2 * 3/2006 Intile ..... F23R 3/002 60/752

FOREIGN PATENT DOCUMENTS

EP 1555443 A1 * 7/2005 ..... F23R 3/002
EP 1555443 B1 * 4/2007 ..... F16B 21/02

* cited by examiner

*Primary Examiner* — Lee A Holly
(74) *Attorney, Agent, or Firm* — Dority & Manning, P.A.

(57) ABSTRACT

A method for assembling a combustor includes positioning an alignment tool in an axial channel of a combustor liner. The alignment tool includes a base and an alignment rod extending from the base. The method further includes positioning a cover plate around the combustor liner. A plurality of cooling holes are defined in the cover plate. The method further includes aligning the cover plate with the combustor liner by inserting the alignment rod through one of the plurality of cooling holes.

18 Claims, 5 Drawing Sheets

ALIGNMENT TOOLS AND METHODS FOR ASSEMBLING COMBUSTORS

FIELD

The present disclosure relates generally to alignment tools and methods for assembling combustors, as well as to aligned combustor assemblies. In particular, the present disclosure relates to tools and methods which facilitate the alignment of a cover plate with a combustor liner.

BACKGROUND

Turbine systems are widely utilized in fields such as power generation. For example, a conventional gas turbine system includes a compressor, a combustor, and a turbine. During operation of a turbine system, many components of the system may be subjected to significant structural vibrations and thermal expansion. These effects can stress the components and eventually cause the components to fail.

Of particular concern in many turbine systems is the combustor liner. Traditional gas turbine combustors use diffusion (i.e., non-premixed) combustion in which fuel and air enter the combustion chamber separately. The process of mixing and burning can produce flame temperatures exceeding 3900° F. Due to such high temperatures, steps to protect the combustor liner must be taken. This has typically been done by film-cooling which involves introducing relatively cool compressor air into a plenum formed by the combustor liner surrounding the outside of the combustor.

One significant improvement in such cooling efforts has been the development of a cover plate which is positioned on the outside of the combustor liner to define a plurality of passages therebetween. Cooling air is directed through the cover plate to the passages, and then flows through the passages to cool the combustor liner.

However, assembly of the cover plate to the combustor liner is difficult and time consuming. Cooling holes in the cover plate must be precisely aligned with corresponding channels in the combustor liner for the desired cooling of the combustor liner to be successful. Misalignment can result in damage to or failure of the combustor liner.

Accordingly, improved methods and apparatus for assembly combustors are desired in the art. In particular, methods and apparatus which facilitate improved, precise alignment of the cover plate with the combustor liner would be advantageous.

BRIEF DESCRIPTION

Aspects and advantages of the invention will be set forth in part in the following description, or may be obvious from the description, or may be learned through practice of the invention.

In accordance with one embodiment, the present disclosure is directed to a method for assembling a combustor. The method includes positioning an alignment tool in an axial channel of a combustor liner. The alignment tool includes a base and an alignment rod extending from the base. The method further includes positioning a cover plate around the combustor liner. A plurality of cooling holes are defined in the cover plate. The method further includes aligning the cover plate with the combustor liner by inserting the alignment rod through one of the plurality of cooling holes.

In accordance with another embodiment, the present disclosure is directed to an alignment tool for assembling a combustor. The combustor includes a combustor liner and a cover plate, the combustor liner having an aft end and an annular array of channels defined at the aft end, the cover plate defining an annular array of cooling holes. The alignment tool includes a base, the base positionable in one of the channels. The alignment tool further includes an alignment rod extending from the base, the alignment rod insertable through one of the cooling holes.

In accordance with another embodiment, the present disclosure is directed to an aligned combustor assembly. The aligned combustor assembly includes a combustor liner, the combustor liner having an aft end and an annular array of channels defined at the aft end. The aligned combustor assembly further includes a cover plate surrounding the combustor liner, the cover plate defining an annular array of cooling holes. The aligned combustor assembly further includes an alignment tool, the alignment tool including a base and an alignment rod extending from the base, the base positioned in one of the channels, the alignment rod inserted through one of the cooling holes. The one of the cooling holes is aligned with the one of the channels.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION

A full and enabling disclosure of the present invention, including the best mode thereof, directed to one of ordinary skill in the art, is set forth in the specification, which makes reference to the appended figures, in which.

DETAILED DESCRIPTION

Figure 1:
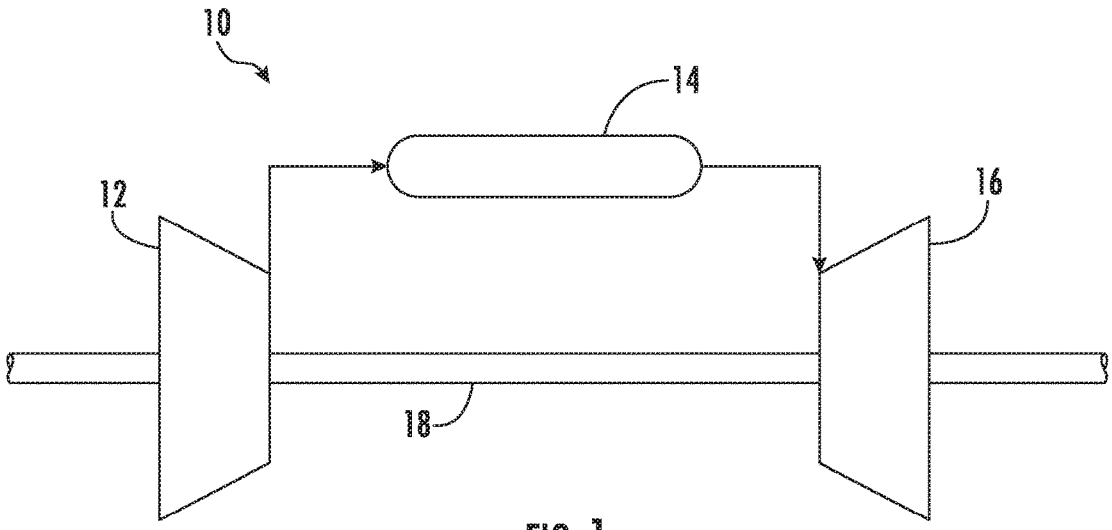
FIG. 1 is a schematic illustration of a gas turbine system in accordance with embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic diagram of one embodiment of a gas turbine system 10. The system 10 may include a compressor 12, a combustor 14, and a turbine 16. Further, the system 10 may include a plurality of compressors 12, combustors 14, and turbines 16. The compressors 12 and turbines 16 may be coupled by a shaft 18. The shaft 18 may be a single shaft or a plurality of shaft segments coupled together to form shaft 18.

Figure 2:
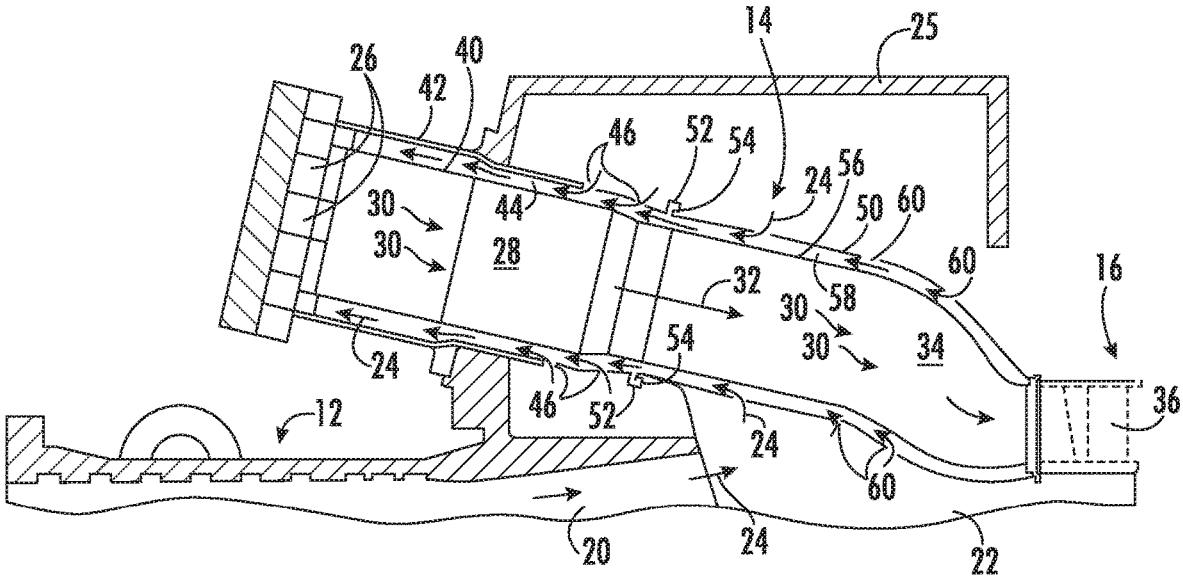
FIG. 2 is a side cutaway view of various components of a gas turbine system in accordance with embodiments of the present disclosure.
Figure 3:
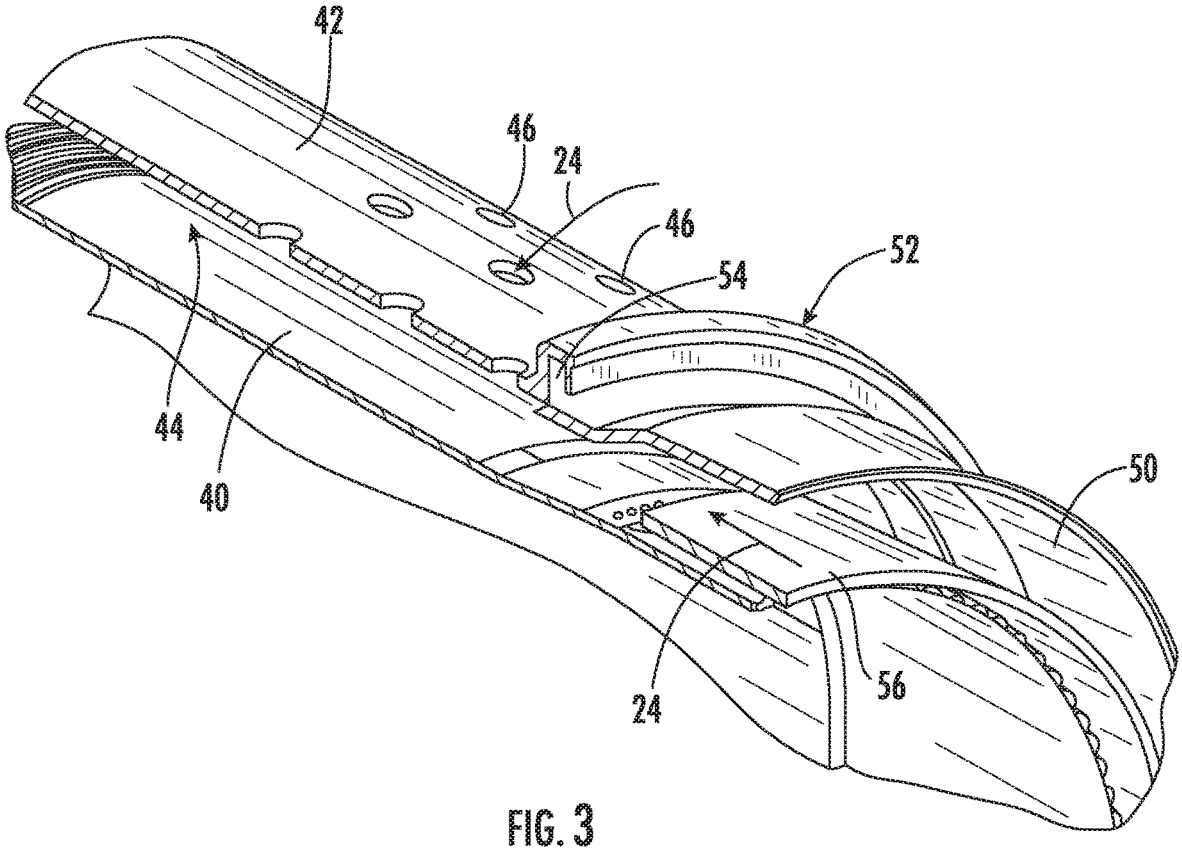
FIG. 3 is a cutaway perspective view of a combustor liner and a flow sleeve coupled to a transition piece in accordance with embodiments of the present disclosure.

Referring now to FIGS. 2 and 3, the combustor 14 is generally fluidly coupled to the compressor 12 and the turbine 16. The compressor 12 may include a diffuser 20 and a discharge plenum 22 that are coupled to each other in fluid communication, so as to facilitate the channeling of a working fluid 24 to the combustor 14. As shown, at least a portion of the discharge plenum 22 is defined by an outer casing 25, such as a compressor discharge casing. After being compressed in the compressor 12, working fluid 24 may flow through the diffuser 20 and be provided to the discharge plenum 22. The working fluid 24 may then flow from the discharge plenum 22 to the combustor 14, wherein the working fluid 24 is combined with fuel from fuel nozzles 26. After mixing with the fuel, the working fluid 24/fuel mixture may be ignited within combustion chamber 28 to create hot gas flow 30. The hot gas flow 30 may be channeled through the combustion chamber 28 along a hot gas path 32 into a transition piece cavity 34 and through a turbine nozzle 36 to the turbine 16.

The combustor 14 may comprise a hollow annular wall configured to facilitate working fluid 24. For example, the combustor 14 may include a combustor liner 40 disposed within a flow sleeve 42. The arrangement of the combustor liner 40 and the flow sleeve 42 is generally concentric and may define an annular passage or flow path 44 therebetween. In certain embodiments, the flow sleeve 42 and the combustor liner 40 may define a first or upstream hollow annular wall of the combustor 14. The flow sleeve 42 may include a plurality of inlets 46, which provide a flow path for at least a portion of the working fluid 24 from the compressor 12 through the discharge plenum 22 into the flow path 44. In other words, the flow sleeve 42 may be perforated with a pattern of openings to define a perforated annular wall. The interior of the combustor liner 40 may define the substantially cylindrical or annular combustion chamber 28 and at least partially define the hot gas path 32 through which hot gas flow 30 may be directed.

Downstream from the combustor liner 40 and the flow sleeve 42, an impingement sleeve 50 may be coupled to the flow sleeve 42. The flow sleeve 42 may include a mounting flange 52 configured to receive a mounting member 54 of the impingement sleeve 50. A transition piece 56 may be disposed within the impingement sleeve 50, such that the impingement sleeve 50 surrounds at least a portion of the transition piece 56. A concentric arrangement of the impingement sleeve 50 and the transition piece 56 may define an annular passage or flow path 58 therebetween. The impingement sleeve 50 may include a plurality of inlets 60, which may provide a flow path for at least a portion of the working fluid 24 from the compressor 12 through the discharge plenum 22 into the flow path 58. In other words, the impingement sleeve 50 may be perforated with a pattern of openings to define a perforated annular wall. Interior cavity 34 of the transition piece 56 may further define hot gas path 32 through which hot gas flow 30 from the combustion chamber 28 may be directed into the turbine 16.

As shown, the flow path 58 is fluidly coupled to the flow path 44. Thus, together, the flow paths 44 and 58 define a flow path configured to provide working fluid 24 from the compressor 12 and the discharge plenum 22 to the fuel nozzles 26, while also cooling the combustor 14.

As discussed above, the turbine system 10, in operation, may intake working fluid 24 and provide the working fluid 24 to the compressor 12. The compressor 12, which is driven by the shaft 18, may rotate and compress the working fluid 24. The compressed working fluid 24 may then be discharged into the diffuser 20. The majority of the compressed working fluid 24 may then be discharged from the compressor 12, by way of the diffuser 20, through the discharge plenum 22 and into the combustor 14. Additionally, a small portion (not shown) of the compressed working fluid 24 may be channeled downstream for cooling of other components of the turbine engine 10.

As shown, the outer casing 25 defining the discharge plenum 22 may at least partially surround the impingement sleeve 50 and the flow sleeve 42. A portion of the compressed working fluid 24 within the discharge plenum 22 may enter the flow path 58 by way of the inlets 60. The working fluid 24 in the flow path 58 may then be channeled upstream through flow path 44, such that the working fluid 24 is directed over the combustor liner 34. Thus, a flow path is defined in the upstream direction by flow path 58 (formed by impingement sleeve 50 and transition piece 56) and flow path 44 (formed by flow sleeve 42 and combustor liner 40). Accordingly, flow path 44 may receive working fluid 24 from both flow path 58 and inlets 46. The working fluid 24 flowing through the flow path 44 may then be channeled upstream towards the fuel nozzles 26, as discussed above.

Figure 4:
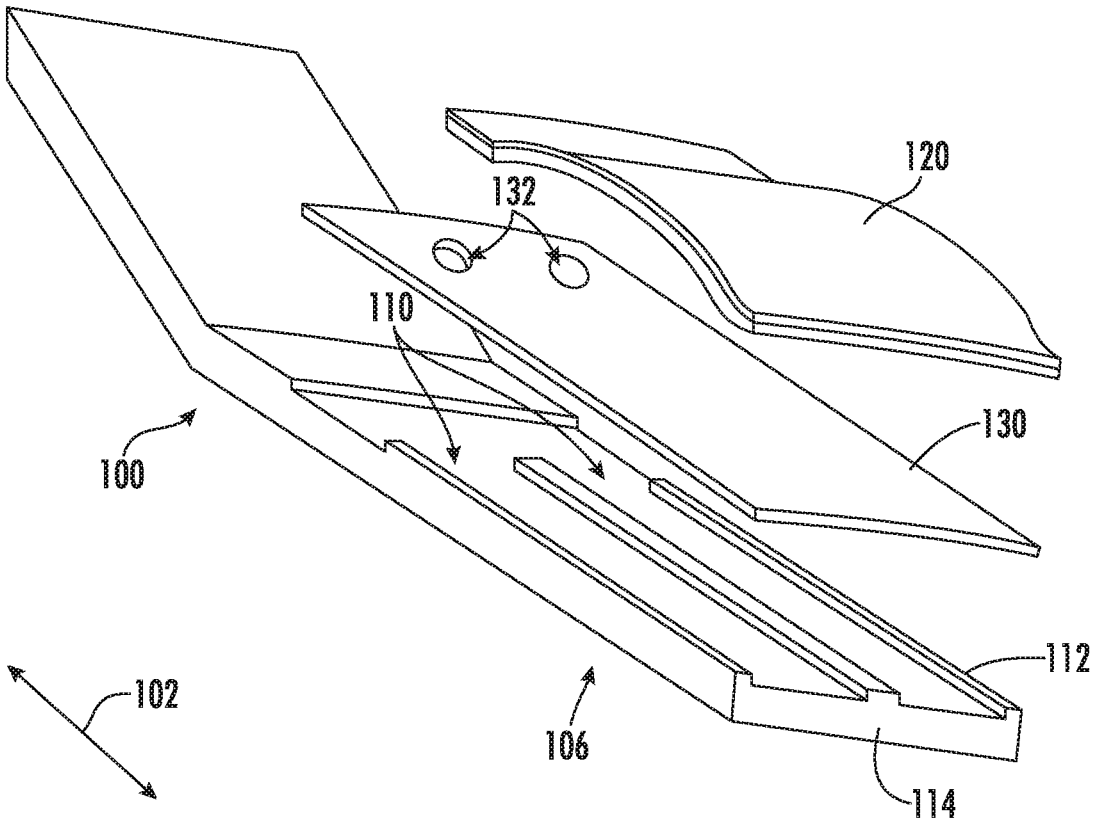
FIG. 4 is a partial exploded view of an aft end of a combustor liner in accordance with embodiments of the present disclosure.

Referring now to FIG. 4, an aft end 106 of a combustor liner 100 is illustrated. Combustor liner 100 may, for example, be combustor liner 40 as discussed above. The combustor liner 100 may extend generally along a longitudinal axis 102 between a forward end and the aft end 106, with hot gas flow (such as hot gas flow 30) traversing from the forward end towards the aft end 106. A compression-type seal 120, which may for example be a hula seal, may be positioned between the aft end 106 and a forward end of the transition piece (such as transition piece 56). A cover plate 130 may be positioned between the seal 120 and the aft end 106. Cover plate 130 may advantageously facilitate improved cooling of the aft end 106.

Figure 5:
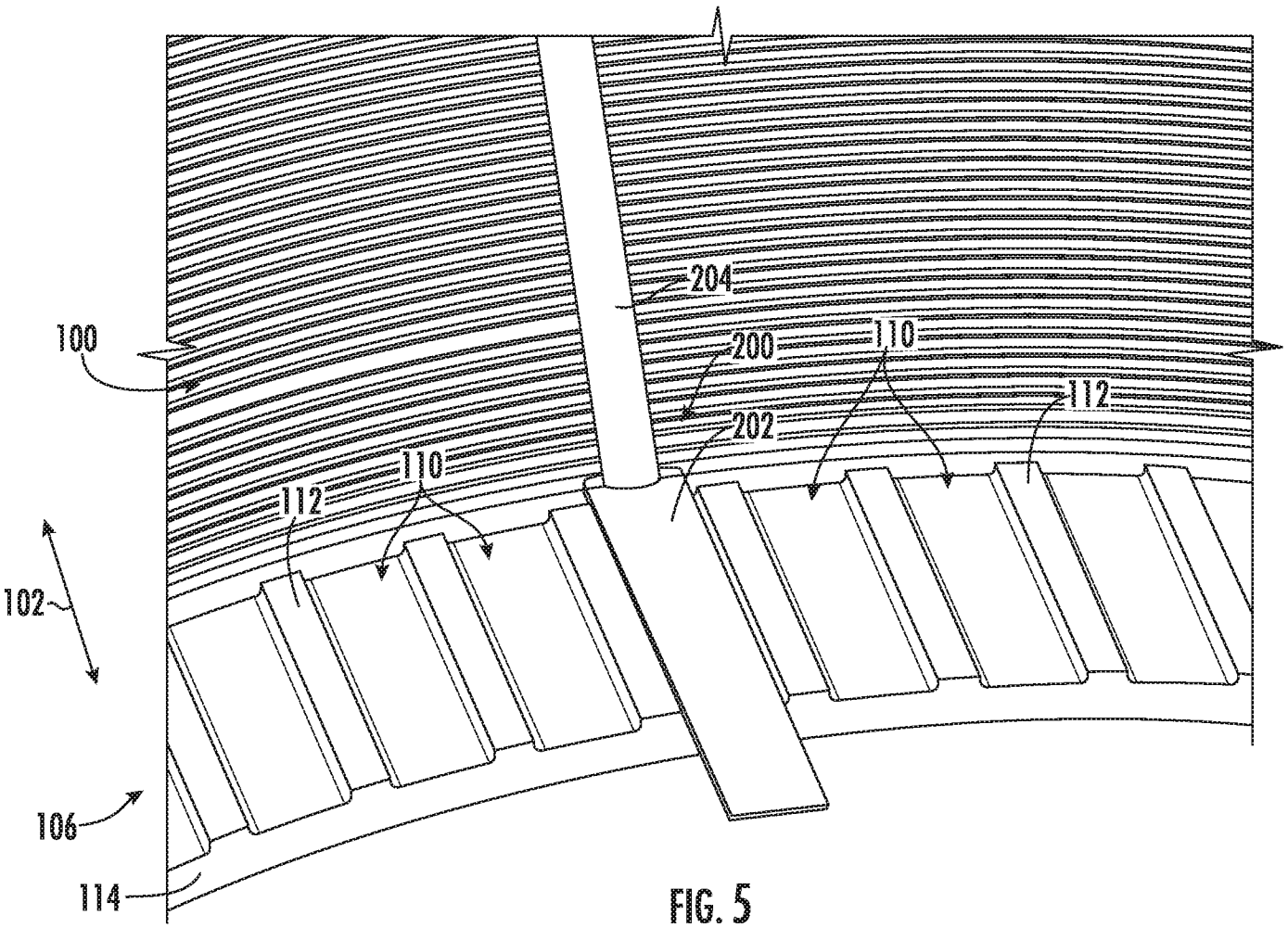
FIG. 5 is an end perspective view of a combustor liner with an alignment tool positioned thereon in accordance with embodiments of the present disclosure.
Figure 6:
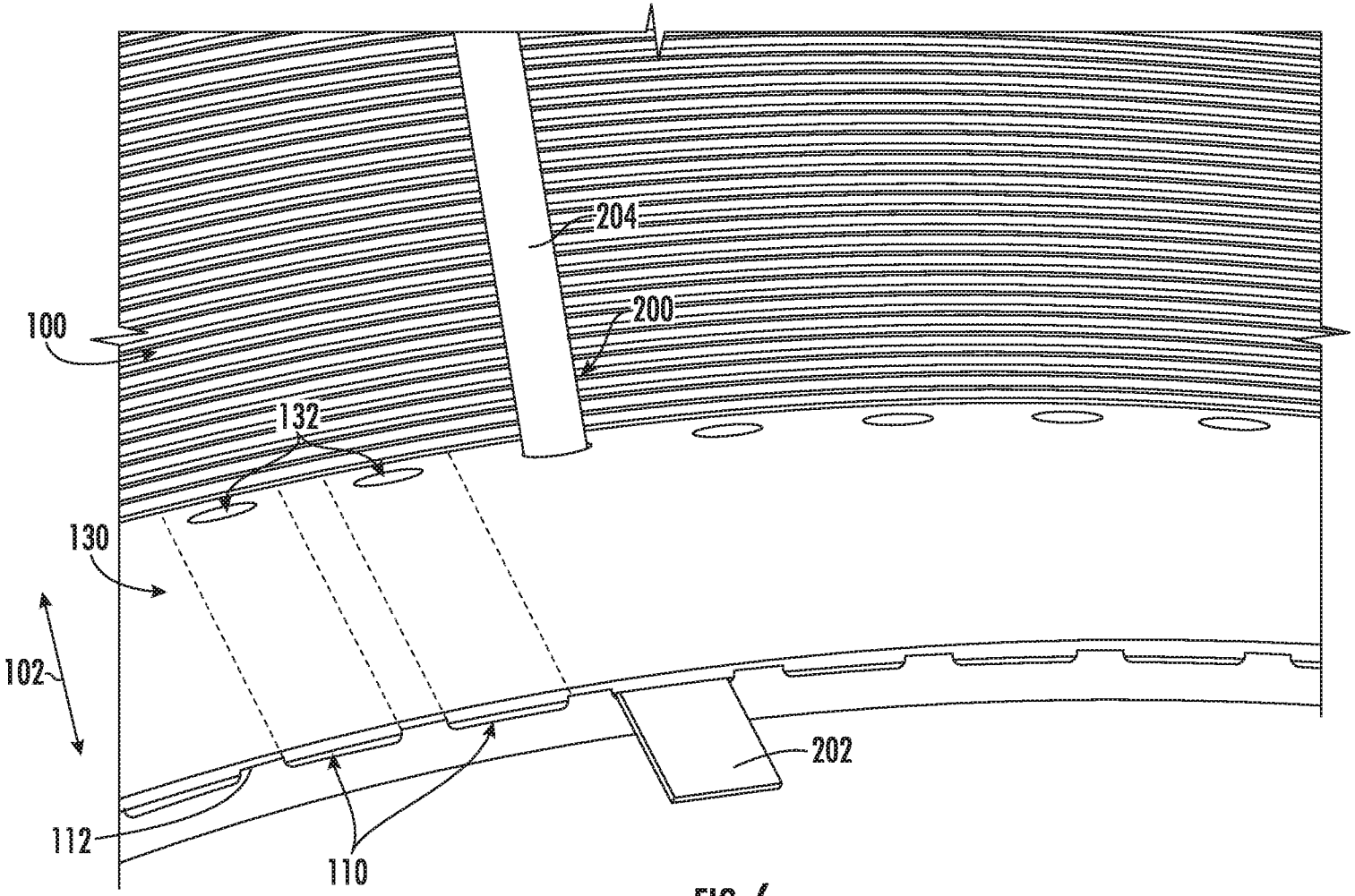
FIG. 6 is an end perspective view of a combustor liner with an alignment tool positioned thereof and a cover plate positioned relative to the combustor liner in accordance with embodiments of the present disclosure.

For example, and referring now additionally to FIGS. 3, 5 and 6, one or more axial channels 110 may be defined in the aft end 106, such as in an outer surface 112 of the liner 100 which defines the aft end 106. Each axial channel 110 may extend from the end edge 114 of the liner 100 through at least a portion of the aft end 106, such as generally along the longitudinal axis 102. In exemplary embodiments, a plurality of axial channels 110 are defined in the aft end 106. The axial channels 110 may be disposed in an annular array, as shown.

Cover plate 130 may be mounted to the combustor liner 100, such as to the aft end 106 thereof. For example, in exemplary embodiments, the cover plate 130 may be welded to the aft end 106. In exemplary embodiments, the cover plate 130 may be an annular cover plate 130. The cover plate 130 may be mounted to the outer surface 112, and may thus cover the channels 110. Accordingly, the channels 110 and cover plate 130 may together form a plurality of axial passages between the aft end 106 and cover plate 130.

One or more cooling holes 132 may be defined in the cover plate 130, such as in a forward end of the cover plate. Each cooling hole 132 may extend through the cover plate 130. In exemplary embodiments, the cooling holes 132 are disposed in an annular array, as shown. When the cover plate 130 is mounted to the combustor liner 100, each cooling hole 132 may be aligned with a channel 110. When the cooling hole 132 is aligned with the channel 110, working fluid (such as working fluid 24) which flows through the cooling hole 132 may flow directly from the cooling hole 132 into that channel 110. Accordingly, the aligned cooling hole 132 and channel 110 may generally have the same radial position.

During operation, a portion of the working fluid (such as working fluid 24) flowing over the cover plate 130 may flow through the cooling holes 132. This working fluid may then enter the channels 110, and may flow through the channels 110 towards the aft end edge 114. The working fluid may then be exhausted from the channels 110 at the aft end edge 114.

As discussed, cooling of the combustor liner 100 is of vital importance. In particular, it is critically important that the cover plate 130 and combustor liner 100 be properly aligned such that the cooling holes 132 and channels 110 are, in turn, properly aligned. Mis-alignment would result in working fluid not being adequately communicated through the cooling holes 132.

Accordingly, as illustrated in FIGS. 5 and 6, an alignment tool 200 may be utilized to precisely position the cover plate 130 relative to the combustor liner 100. Alignment tool 200 is advantageously efficient and easy to utilize while providing repeatable, accurate results.

Alignment tool 200 may include a base 202 and an alignment rod 204 which extends from the base 202. The base 202 is positionable in one or more of the channels 110. The rod 204 is insertable through one or more of the cooling holes 132.

In some embodiments, the alignment rod 204 may extend perpendicularly from the base 202. In some embodiments, the base 202 may be a plate, and may thus be generally rectangular. In some embodiments, the rod 204 may be cylindrical. In general, the base 202 may be sized and shaped to fit within at least one of the plurality of channels 110. For example, the base 202 may have a width that corresponds to the width of at least one channel 110, such that there is minimal width-wise movement of the base 202 when inserted into the channel 110. Such dimensioning facilitates the accurate positioning of the cover plate 130 relative to the liner 100. In general, the rod 204 may be sized and shaped to fit within at least one of the plurality of cooling holes 132. For example, the rod 204 may have a width (which may be a diameter) that corresponds to the width (which may be a diameter) of the at least one cooling hole 132, such that there is minimal width- or diameter-wise movement of the cover plate 130 relative to the rod 204 when the rod 204 is inserted into the cooling hole 132.

Alignment tool 200 is utilized to align the cover plate 130 with the combustor liner 100, and to thus align each cooling hole 132 with an associated channel 110. To utilize the alignment tool 200, tool 200 (such as the base 202 thereof) is initially positioned in one of the channels 110. The cover plate 130 is then positioned around the combustor liner 100 (such as the aft end 106 thereof). The cover plate 130 is then aligned with the combustor liner 100, by inserting the rod 204 through one of the cooling holes 132. The geometric relationship between the rod 204 and base 202 advantageously causes the cooling hole 132 to be aligned with the associated cover plate 130. Additionally, in some embodiments, due to the generally equal spacing of the channels 110 and the generally equal spacing of the cooling holes 132, such alignment may cause each of the cooling holes 132 to be aligned with an associated one of the channels 110. Accordingly, an aligned combustor assembly is achieved.

As discussed, the present disclosure is further directed to methods for assembling combustors, such as combustors 14. A method may include, for example, the step of positioning an alignment tool 200 (such as the base 202 thereof) in an axial channel 110 of a combustor liner 100, as discussed herein and as illustrated in FIG. 5. A method may further include, for example, the step of positioning a cover plate 130 around the combustor liner 100 (such as an aft end 106 thereof), as discussed herein and as illustrated in FIG. 6. A method may further include, for example, the step of aligning the cover plate 130 with the combustor liner 100, such as by inserting the alignment rod 204 through one of the cooling holes 132 defined in the cover plate 130, as discussed herein and as illustrated in FIG. 6.

A method may further include, for example, the step of connecting the cover plate 130 to the combustor liner 100, such as to the aft end 106 thereof. Such connecting may include, for example, welding the cover plate 130 to the combustor liner 100, such as to the aft end 106 thereof. The connecting step may, for example, occur after the aligning step discussed herein. After such connecting, the now-mounted cover plate 130 may advantageously be accurately aligned with the combustor liner 100 to facilitate improved cooling of the aft end 106 of the combustor liner 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for assembling a combustor, the method comprising:

positioning an alignment tool in an axial channel of a plurality of axial channels defined in a combustor liner, the plurality of axial channels disposed in an annular array, the alignment tool comprising a base and an alignment rod extending from the base;

positioning a cover plate around the combustor liner, wherein a plurality of cooling holes is defined in the cover plate; and aligning the cover plate with the combustor liner by inserting the alignment rod through one of the plurality of cooling holes.

2. The method of claim 1, further comprising connecting the cover plate to the combustor liner.

3. The method of claim 2, wherein connecting the cover plate to the combustor liner comprises welding the cover plate to the combustor liner.

4. The method of claim 2, wherein the connecting step occurs after the aligning step.

5. The method of claim 1, wherein the base of the alignment tool is positioned in an axial channel of the plurality of axial channels.

6. The method of claim 1, wherein the axial channel is defined at an aft end of the combustor liner.

7. The method of claim 1, wherein the plurality of cooling holes is disposed in an annular array.

8. The method of claim 1, wherein the base of the alignment tool is a plate.

9. A method for assembling a combustor, the method comprising:

positioning an alignment tool in an axial channel of a combustor liner, the alignment tool comprising a base and an alignment rod extending from the base;

positioning a cover plate around the combustor liner, wherein a plurality of cooling holes is defined in the cover plate;

aligning the cover plate with the combustor liner by inserting the alignment rod through one of the plurality of cooling holes; and welding the cover plate to the combustion liner.

10. The method of claim 9, wherein the welding step occurs after the aligning step.

11. The method of claim 9, wherein the base of the alignment tool is positioned in the axial channel.

12. The method of claim 9, wherein the axial channel is one of a plurality of axial channels defined in the combustor liner, the plurality of axial channels disposed in an annular array.

13. The method of claim 9, wherein the axial channel is defined at an aft end of the combustor liner.

14. The method of claim 9, wherein the plurality of cooling holes is disposed in an annular array.

15. The method of claim 9, wherein the base of the alignment tool is a plate.

16. The method of claim 9, wherein the alignment rod extends perpendicularly from the base.

17. The method of claim 9, wherein the alignment rod is cylindrical.

18. The method of claim 9, wherein the cover plate is annular.

* * * * *